US006441788B1

(12) United States Patent
Ishizuka et al.

(10) Patent No.: US 6,441,788 B1
(45) Date of Patent: Aug. 27, 2002

(54) ANTENNA ATTACHMENT STRUCTURE OF A CASE

(75) Inventors: Shinichi Ishizuka, Tokyo-To; Yasuhiro Minoura, Tomioka, both of (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 09/642,776

(22) Filed: Aug. 22, 2000

(30) Foreign Application Priority Data

Aug. 24, 1999 (JP) ..... 11-236285

(51) Int. Cl.[7] ..... H01Q 1/24; H01Q 1/12
(52) U.S. Cl. ..... 343/702; 343/718
(58) Field of Search ..... 343/702, 906, 343/718, 900, 715, 711, 713; H01Q 1/12, 1/24

(56) References Cited

U.S. PATENT DOCUMENTS 5,650,789 A * 7/1997 Elliott et al. ..... 343/702
5,686,927 A * 11/1997 Simmons ..... 343/702
5,717,408 A * 2/1998 Sullivan et al. ..... 343/702
5,717,409 A * 2/1998 Garner et al. ..... 343/702
5,940,745 A * 8/1999 Imura ..... 455/90
6,002,372 A * 12/1999 Sullivan ..... 343/702
6,031,493 A * 2/2000 Tsuda et al. ..... 343/702
6,133,885 A * 10/2000 Luniak et al. ..... 343/702
6,215,446 B1 * 4/2001 Sullivan ..... 343/702

* cited by examiner

*Primary Examiner*—Don Wong
*Assistant Examiner*—Trinh Do Dinh
(74) *Attorney, Agent, or Firm*—Dickstein Shapiro Morin & Oshinsky LLP

(57) ABSTRACT

An antenna structure obtains a snap-in antenna having a short signal transmission path, it being possible to switch between an antenna of a case and an outside antenna with low transmission loss. When an antenna side attachment section is inserted into an antenna attachment hole, a plunger is elastically forced so as to protrude in a direction intersecting with the insertion direction of a spring connector provided on a circuit board and elastically contacts a conductive member which is electrically connected to an antenna base. A small through-hole is provided in the conductive member at the contact position; a second spring connector is provided on the antenna attachment section and has a second plunger, one end of the plunger passing through the through-hole and being elastically forced toward the other side so as to project thereto; a coaxial connector containing section is provided at the other end and a coaxial connector can be inserted therein. A coaxial connector insertion hole is provided in the case facing the coaxial connector containing section. When the coaxial connector is inserted, a central conductor thereof applies a pressing force to the plunger of the spring connector, thereby separating it from the conductive member.

20 Claims, 7 Drawing Sheets

ANTENNA ATTACHMENT STRUCTURE OF A CASE

BACKGROUND OF THE INVENTION

1. Field of the Invention

The present invention relates to an antenna structure in which an antenna is electrically connected to a circuit board when an antenna side attachment section is inserted into an antenna attachment hole provided in a case. Furthermore, this invention relates to the antenna structure wherein an outside antenna is switch-connected to the circuit board when a coaxial connector is inserted.

2. Description of the Related Art

One example of an antenna, which is secured by being projected to the outside of a case of a mobile telephone, is known as a snap-in antenna. The snap-in antenna is secured by being inserted into an antenna attachment hole provided in the case, whereby the base of the antenna electrically connects to a circuit board. One example of a structure of such an antenna will be briefly explained. An elastically deforming tongue-piece is provided parallel to the diameter of an antenna side attachment section with its insertion tip side as the free end. An outwardly projecting clip is provided at the free end of the tongue-piece. An antenna attachment hole is provided in the case and allows the clip to be inserted therein while the tongue-piece elastically deforms. A clip section restricts the movement of the clip in the extraction direction after the clip has clipped to the case in the inserted state. A conductive spring member provided on a circuit board in the case elastically contacts and electrically connects to a conductive metal fitting which the base of the antenna is electrically connected to.

When the mobile phone is used inside a vehicle, the connection is switched to an outside antenna provided on the outside of the vehicle in order to improve the quality of the communication. This is achieved by the following structure. The outside antenna connects to a male coaxial connector. A female coaxial connector is provided on the case and comprises a switching circuit which is switched when the male coaxial connector is inserted. The connection between the antenna secured to the case and the outside antenna secured outside the vehicle switches ON and OFF depending on whether the male coaxial connector is inserted.

In the conventional snap-in antenna described above, the signal transmission path of the conductive spring member, which electrically connects the conductive metal fitting of the antenna to the circuit board, is comparatively long, and the antenna effect of the conductive spring member has a considerable influence on the overall antenna characteristics. Using a conductive spring member having a coaxial structure would complicate the structure and is therefore impractical. For these reasons, it has been difficult to obtain the desired antenna characteristics.

The female coaxial connector comprises a switching circuit for switching between the antenna secured to the case and the outside antenna secured outside the vehicle. The female coaxial connector has considerable transmission loss, and its large mount area makes miniaturization difficult.

SUMMARY OF THE INVENTION

The present invention has been achieved in order to improve the above-described difficulties of the conventional technology.

It is an object of this invention to provide an antenna structure in which the signal transmission path from the antenna to the circuit board can be shortened.

It is a further object of this invention to provide an antenna structure in which it is possible to switch between an antenna secured to a case and an outside antenna secured outside a vehicle with low transmission loss.

To achieve the objects, the antenna structure of this invention comprises a case having an antenna attachment hole, which an attachment section of an antenna can be inserted into. A spring connector is provided on a circuit board inside the case and has a plunger. The plunger is elastically forced to protrude in a direction which intersects the insertion direction of antenna the attachment section into the case. A conductive member is provided to the attachment section of said antenna and electrically connects to the base of the antenna. When the attachment section is inserted into said antenna attachment hole while said conductive member is facing said plunger, the plunger elastically contacts the conductive member.

Further, the antenna structure of this invention comprises a conductive member which is electrically connected to the base of the antenna; a spring connector having a plunger which elastically contacts the conductive member and being provided on the circuit board provided in the case; a through-hole which is provided at the position on the conductive member which the plunger elastically contacts, the through-hole having a diameter which is narrower than the tip face of the plunger; a second spring connector which has a second plunger, one end of the second plunger passing through said through-hole and directly contacting the plunger and being elastically forced in the direction of its other end; and a coaxial connector containing section which is provided at the other end of the second plunger of the second spring connector and which a coaxial connector can be inserted into. A center conductor of the inserted coaxial connector forcibly moves the second plunger so that it directly contacts the plunger. The plunger resists the elasticity and is moved by a pressing force, thereby becoming separated from the conductive member.

DESCRIPTION OF THE PREFERRED EMBODIMENTS

Figure 1:
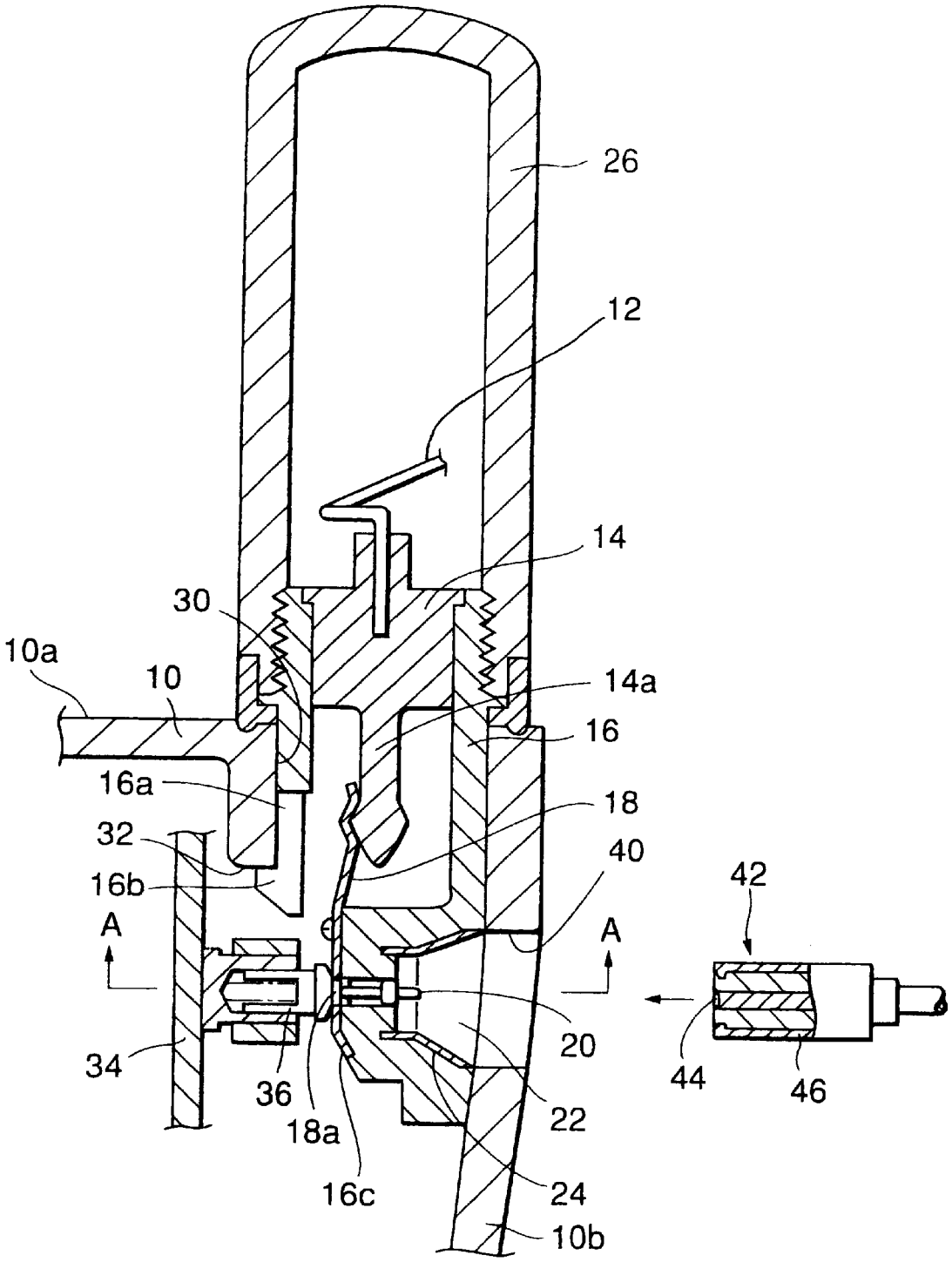
FIG. 1 is a vertical cross-sectional view of a first embodiment of the antenna structure of the present invention showing the state when the antenna is inserted into the case and secured.
Figure 2:
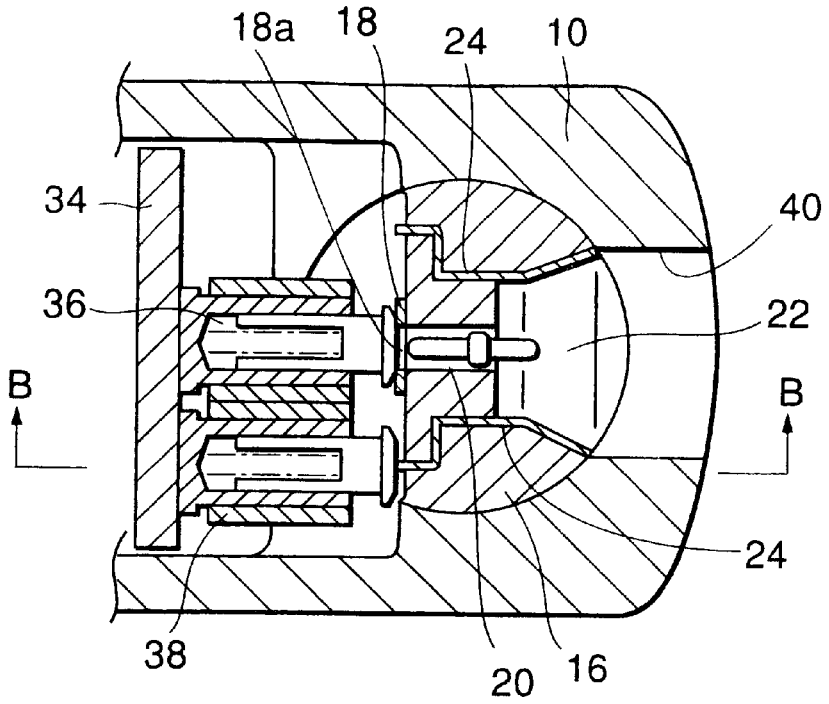
FIG. 2 is an enlarged cross-sectional view taken substantially along the line A—A in FIG. 1.
Figure 3:
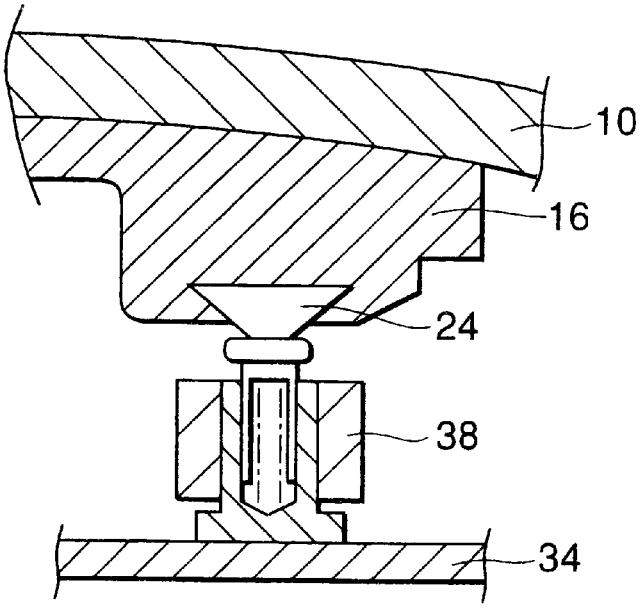
FIG. 3 is a cross-sectional view taken substantially along the line B—B in FIG. 2.
Figure 4:
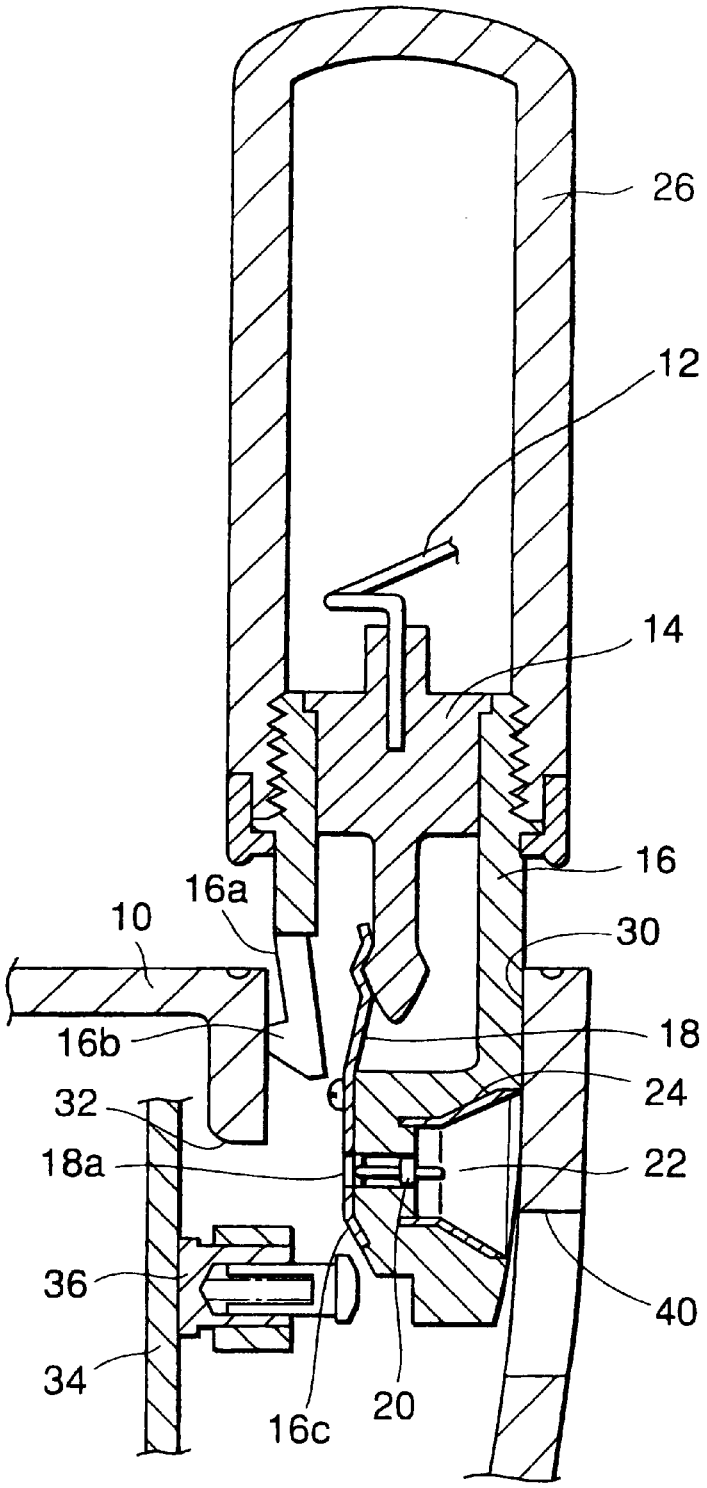
FIG. 4 is a vertical cross-sectional view of the antenna being inserted into the case.
Figure 5:
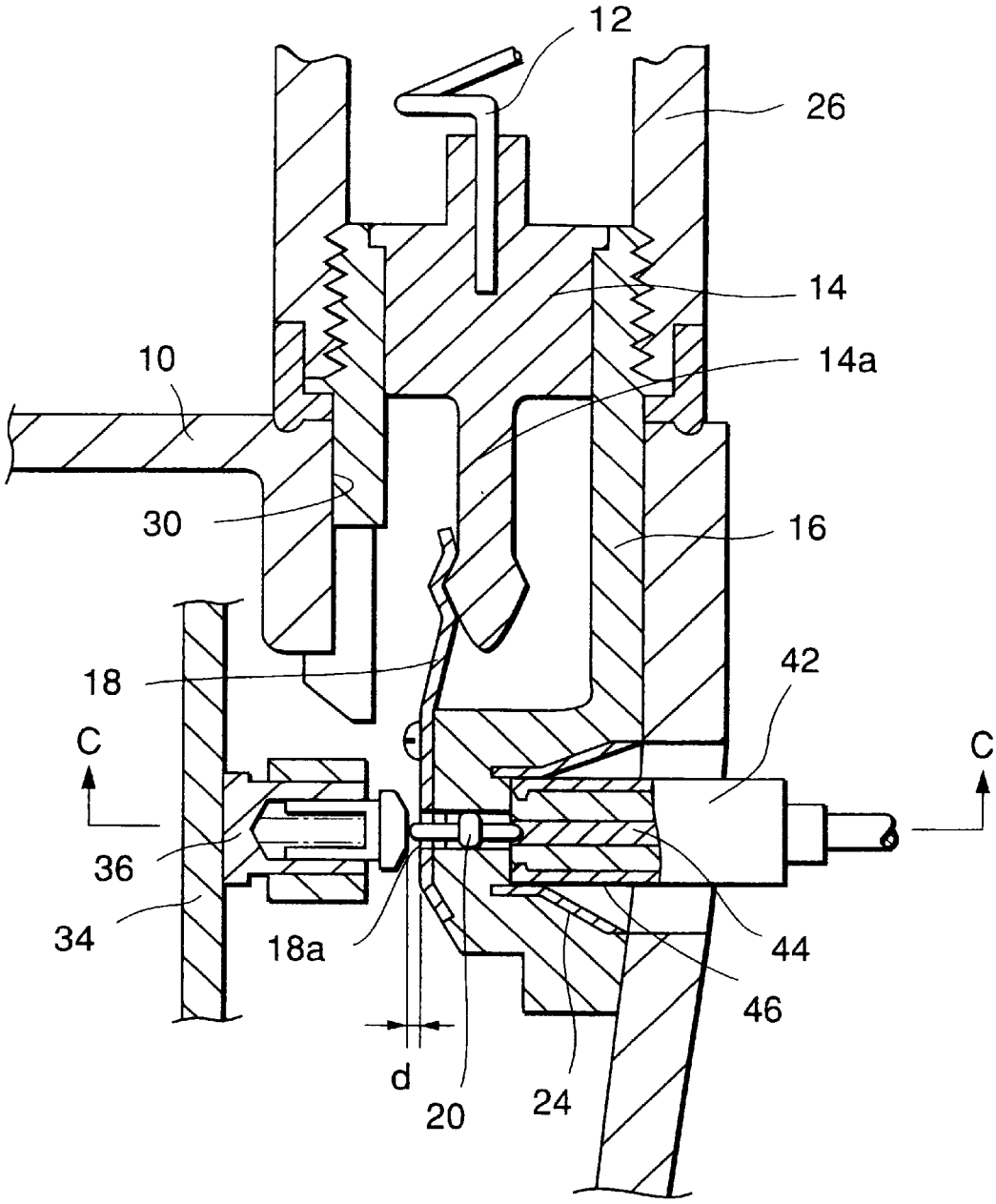
FIG. 5 is an enlarged vertical cross-sectional view of the primary sections in the state where a coaxial connector is inserted to the case after the antenna has been inserted and secured thereto.
Figure 6:
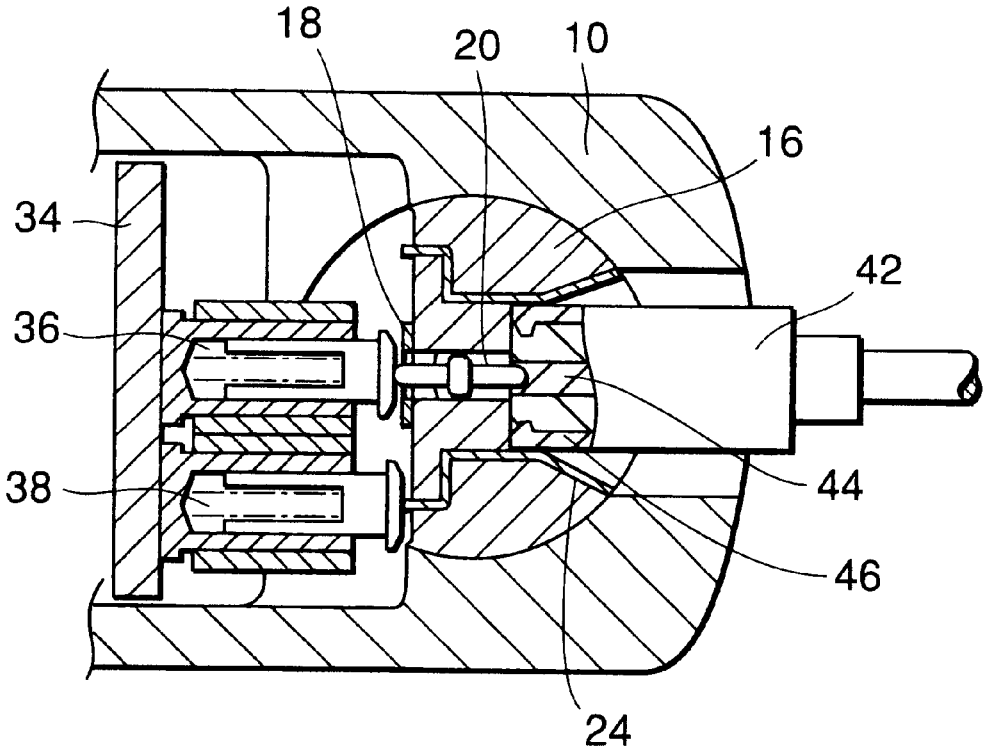
FIG. 6 is a cross-sectional view taken substantially along the line C—C in FIG. 5.

A first preferred embodiment of the present invention will be explained with reference to FIGS. 1 to 6. FIG. 1 is a vertical cross-sectional view of a first embodiment of the antenna structure of the present invention showing the state when the antenna is inserted into the case and secured. FIG. 2 is an enlarged cross-sectional view taken substantially along the line A—A in FIG. 1. FIG. 3 is a cross-sectional view taken substantially along the line B—B in FIG. 2. FIG. 4 is a vertical cross-sectional view of the antenna being inserted into the case. FIG. 5 is an enlarged vertical cross-sectional view of the primary portions when a coaxial connector is inserted to the case after the antenna has been inserted and secured thereto. FIG. 6 is a cross-sectional view taken substantially along the line C—C in FIG. 5.

The structure will be explained referring to FIGS. 1 to 3. An antenna, which is secured by being projected to the outside of a case 10 of a mobile telephone or the like, is configured as follows. The base of a helical coil element 12 is secured as appropriate by crimping or the like to a securing metal fitting 14 which comprises a conductive material. A central clip 14*a* is provided in the insertion direction at the base of the securing metal fitting 14. A substantially cylindrical holder 16 comprises an insulating material and is secured around the securing metal fitting 14. A tongue-piece 16*a* can elastically deforms and is provided on the side of the holder 16 parallel to the diameter of the holder 16 with the insertion direction as its free end. A clip 16*b* is provided on the free end of the tongue-piece 16*a* and projects outwardly therefrom. A conductive member 18 comprises a plate-like conductive spring material and is secured as appropriate to the tip side of the holder 16 so that one end of the conductive member 18 elastically contacts the central clip 14*a*. A sloping face 16c continues along one side of the insertion tip side of the conductive member 18. The sloping face 16*c* may be formed by the member of the holder 16 alone, or part of the sloping face 16*c* may be formed by part of the conductive member 18 as shown in FIG. 1, or the entire sloping face 16*c* may be formed by the conductive member 18. A through-hole 18*a* is provided in the conductive member 18. A spring connector 20 is provided on the holder 16 and passes through the through-hole 18*a*. The end of the plunger of the spring connector 20 passes through the through-hole 18*a* without electrically connecting and is elastically forced toward the other side so as to project thereto. On the other side of the spring connector 20, a coaxial connector containing section 22 is provided in the holder 16, and a ground conductor 24 is provided on the inner wall of the coaxial connector containing section 22. The ground conductor 24 projects as far as the face which the conductive member 18 is provided on. A sloping face is provided on the insertion tip side of the projecting portion of the ground conductor 24. An insulating cap 26 covers the helical coil element 12 and is secured by screwing the open end of the cap 26 around the top of the holder 16. The bottom and middle portions of the holder 16 comprise an antenna attachment section which is inserted into the case 10.

An antenna attachment hole 30 is, for example, provided in the top face 10*a* of the case 10 and allows the above-mentioned antenna attachment section to be inserted therein. The antenna attachment hole 30 is formed so that the clip 16*b* can be inserted while the tongue-piece 16*a* elastically deforms. The position in which the antenna attachment section can be inserted is such that, for example, the coaxial connector containing section 22 faces the side wall 10*b* of the case 10. A clip section 32 is provided on the case 10 and clips to the clip 16*b* when the antenna attachment section has been inserted into the antenna attachment hole 30 and the tongue-piece 16*a* has elastically returned to its former position. The clip 16*b* clips to the clip section 32, thereby restricting the movement of the antenna attachment section in the extraction direction. A spring connector 36 is provided on a circuit board 34 provided inside the case 10 and passes through the through-hole 18*a* of the conductive member 18. The tip of the plunger of the spring connector 36 elastically contacts the conductive member 18 so as to block the through-hole 18*a*. The tip face of the plunger has a greater area than the through-hole 18*a* of the conductive member 18. Another spring connector 38 is provided on the circuit board 34 and faces the projecting portion of the ground conductor 24. The tip of the plunger of the spring connector 38 elastically contacts the ground conductor 24. A coaxial connector insertion hole 40 is provided in a side wall 10*b* of the case 10 and faces the coaxial connector containing section 22.

When the antenna side attachment section is inserted into the antenna attachment hole 30 and secured therein, a coaxial connector 42 can be inserted through the coaxial connector insertion hole 40 into the coaxial connector containing section 22. The plunger of the spring connector 20 resists the elasticity of a central conductor 44 of the coaxial connector 42, which is inserted into the coaxial connector containing section 22, and is forcibly moved as a result. Furthermore, an outside conductor 46 directly contacts the ground conductor 24.

The operation of inserting the antenna side attachment section into the antenna attachment hole 30 of the case 10 according to this constitution will be explained based on FIG. 4. As the antenna side attachment section is inserted into the antenna attachment hole 30, the tongue-piece 16*a* elastically deforms as shown in FIG. 4, allowing the clip 16*b* to be inserted. At a predetermined insertion depth, the tongue-piece 16*a* elastically returns to its original shape and the clip 16*b* clips to the clip section 32 of the case 10, thereby securing the antenna. Simultaneous to the insertion, the plunger of the spring connector 36 directly contacts the sloping face 16*c* of the holder 16. As a result of the wedge effect of the sloping face 16*c*, the plunger resists the elasticity and receives a pressing force therefrom. Moreover, as a result of the insertion of the antenna side attachment section, the plunger elastically contacts the conductive member 18 and becomes electrically connected thereto. The base of the helical coil element 12 is electrically connected to the circuit board 34 with the securing metal fitting 14, the central clip 14*a*, the conductive member 18 and the spring connector 36 therebetween in that order. Consequently, the base of the antenna becomes electrically connected to the circuit board 34 when the antenna side attachment section is inserted and secured in the antenna attachment hole 30, thereby forming a snap-in antenna. The antenna is used in this state when the mobile telephone is used outside a vehicle and the like without connecting to an outside antenna (not shown).

An operation of connecting an outside antenna which is secured outside the vehicle to improve the quality of communication when the mobile telephone is used inside the vehicle and the like will be explained based on FIGS. 5 and 6. The coaxial connector 42 electrically connects to the outside antenna and is inserted into the coaxial connector containing section 22 of the holder 16 via the coaxial connector insertion hole 40 provided in the case 10. The central conductor 44 of the coaxial connector 42 directly contacts the plunger of the spring connector 20, and the resultant elasticity applies a pressing force to the plunger, moving it to the opposite side. The tip of the plunger passes through the through-hole 18*a* in the conductive member 18, directly contacting the plunger of the spring connector 36 and pressing it downwards. As a consequence, the plunger of the spring connector 36 separates from the conductive member 18, creating a gap d therebetween and severing the electrical connection. This cuts off the electrical connection between the antenna secured to the case 10 and the circuit board 34. The central conductor 44 of the coaxial connector 42 is electrically connected to the spring connector 36 via the spring connector 20, and the outside antenna becomes electrically connected to the circuit board 34. Therefore, the connection is switched. The outside conductor 46 of the coaxial connector 42 directly contacts the ground conductor 24 and is electrically connected thereto, and the ground conductor 24 is electrically connected to the circuit board 34 via a spring connector 38.

The first embodiment describes a snap-in antenna, but since the antenna is electrically connected to the circuit board 34 by the conductive member 18 and the spring connector 36 which elastically contacts the conductive member 18, the signal transmission path can be made comparatively short, obtaining stable antenna characteristics. By inserting the coaxial connector 42, the central conductor 44 becomes electrically connected to the circuit board 34 with the spring connector 20 and the spring connector 36 therebetween. In addition, the spring connector 36 separates from the conductive member 18, thereby cutting off the electrical connection. Therefore, it is possible to switch the connection between the antenna secured to the case 10 and the outside antenna by using a simple constitution. Furthermore, the transmission loss is low.

Figure 7:
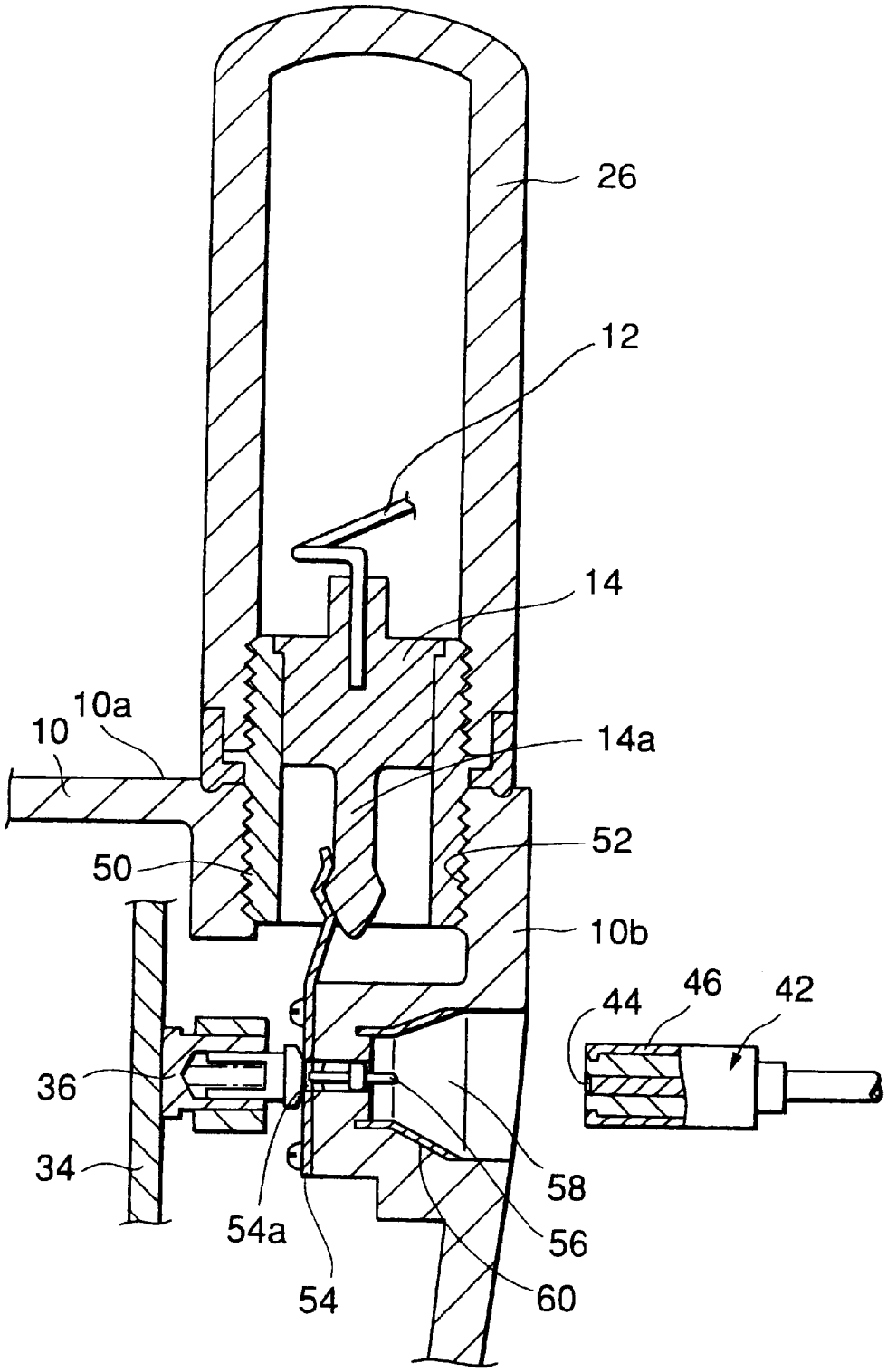
FIG. 7 is a vertical cross-sectional view of a second embodiment of the antenna structure of this invention.

Subsequently, a second embodiment of this invention will be explained based on FIG. 7. FIG. 7 is a vertical cross-sectional view of the second embodiment of the antenna structure of this invention. In FIG. 7, parts which are same or uniform to those in FIGS. 1 to 6 are represented by the same reference codes and explanations thereof are not repeated.

In the second embodiment shown in FIG. 7, the antenna is secured by screwing, and the connection is switched between the antenna secured to the case 10 and the out side antenna by inserting the coaxial connector 42. In FIG. 7, a male thread is provided around the insertion side of a holder 50 of the antenna side attachment section, and a female thread is provided in an antenna attachment hole 52 which is provided in the top face 10*a* of the case 10. The antenna is secured to the case 10 by screwing. A plate-like conductive member 54 comprises a conductive spring material and is secured to the case 10. When the antenna side attachment section is screwed in, one end of the conductive member 54 elastically contacts the central clip 14*a* of the securing metal fitting 14 and becomes electrically connected thereto. The plunger of the spring connector 36 provided on the circuit board 34 inside the case 10 elastically contacts the conductive member 18 and is electrically connected thereto. A through-hole 54*a* has a smaller area than the tip face of the plunger of the spring connector 36 and is provided in the conductive member 54. Another spring connector 56 is secured to the case 10 on the side facing the spring connector 36 with the through-hole 54*a* therebetween. One end of the plunger of this spring connector 56 passes through the through-hole 54*a* and faces the plunger of the spring connector 36. The plunger of the spring connector 56 is elastically pressed in the direction of its other end so that it protrudes to the other side. A coaxial connector containing section 58 is provided by opening the side wall of the case 10 on the side of the other end of the spring connector 56, and a ground conductor 60 is provided around the inside wall thereof. When the coaxial connector 42 is inserted into the coaxial connector containing section 58, the plunger of the spring connector 56 resists the elasticity of the central conductor 44 and is forcibly moved as a result. Consequently, the opposite side of the plunger passes through the through-hole 54*a* of the conductive member 54 and directly contacts the plunger of the spring connector 36, thereby pressing it down and away from the conductive member 54. Thus, the central conductor 44 of the coaxial connector 42 is electrically connected to the circuit board 34 via the spring connector 56 and the spring connector 36, but the electrical connection of the conductive member 54 is cut off. The outside conductor 46 of the coaxial connector 42 directly contacts a ground conductor 60 of the outside conductor 46 and becomes electrically connected thereto, and is electrically connected to the circuit board 34 in the same way as in the first embodiment.

According to the constitution of the second embodiment, the connection can be easily switched from the antenna which is secured to the case 10 to the outside antenna by inserting the coaxial connector 42, and with low transmission loss.

The first embodiment describes a snap-in antenna wherein the antenna connection is switched by inserting the coaxial connector 42, but the present invention can of course be applied to a snap-in antenna in which the connection is not switched to an outside antenna. In the second embodiment, the antenna side attachment section a screw-type attachment section, and the connection is switched to an outside antenna when the coaxial connector 42 is inserted. However, the structure for securing the antenna to the case 10 is not limited to a screw-type such as that of the second embodiment. The antenna is not limited to the helical coil element 12 mentioned above, and can of course comprise a folding antenna element, a whip antenna element, or the like.

Figure 8:
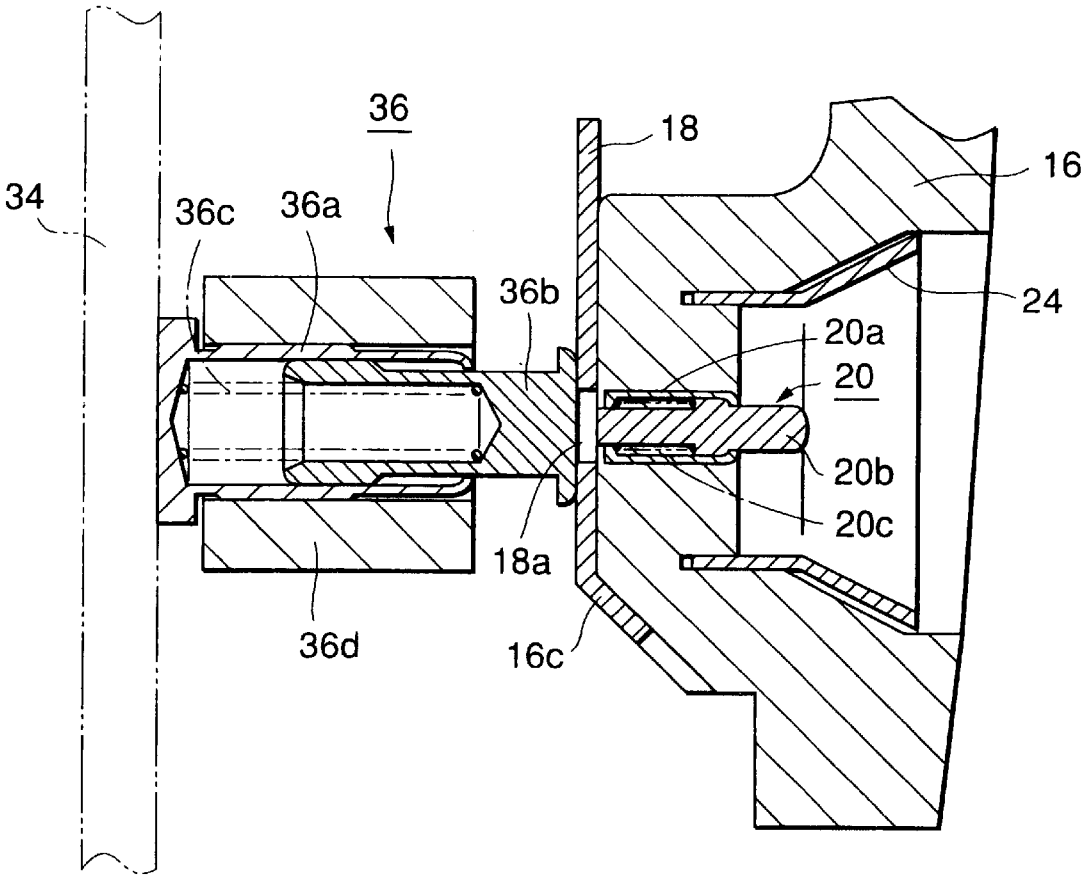
FIG. 8 is a vertical cross-sectional view of the internal constitution of a spring connector which is used in the embodiments of this invention.

FIG. 8 shows the internal constitution of the spring connectors 36 and 20 which are used in the above-described embodiments. The spring connector 36 comprises a cylinder 36*a* which has one open end and is secured to the circuit board 34 by soldering or the like, a plunger 36*b* which is inserted into the open end of the cylinder 36*a*, and an expandable coil spring 36*c* which applies a force to the cylinder 36*a* in the fly-out direction (the rightward direction in FIG. 8). A holding member 36*d* is provided around the cylinder 36*a* and holds the spring connector 36 in the correct position.

The spring connector 20 comprises a cylinder 20*a* which is open at both ends and is cast inside the holder 16, a plunger 20*b* which is inserted into the cylinder 20*a*, and an expandable coil spring 20*c* which is provided in the cylinder 20*a* and forces the plunger 20*b* in the rightward direction of FIG. 8.

In this way, the plungers 36*b* and 20*b* of the two spring connectors 36 and 20 are both forced toward the right. The plunger 36*b* is usually pressed against the face of the conductive member 18, and the plunger 20*b* is pressed so as to prevent it from touching the plunger 36*b*.

The antenna structure configured according to the above explanation has the following particular effects.

According to the antenna structure of the first aspect, the antenna side attachment section is inserted into the antenna attachment hole of the case, whereby the base of the antenna is easily electrically connected to the circuit board via the spring connector. The antenna characteristics are stable since the signal transmission path can be made comparatively short.

According to the antenna structure of the second aspect, the antenna side attachment section is inserted into the antenna attachment hole of the case, whereby the plunger of the spring connector directly contacts the sloping face of the insertion tip side of the conductive member. The wedge effect of the sloping face produces elasticity and applies a pressing force to the plunger. Moreover, as a result of the insertion of the antenna side attachment section, the plunger elastically contacts the conductive member and becomes electrically connected thereto. Therefore, the base of the antenna can be smoothly electrically connected to the circuit board.

According to the antenna structure of the third aspect, which provides a snap-in antenna, the antenna side attachment section is secured to the case by being inserted therein, and the base of the antenna is electrically connected to the circuit board via the conductive member and the spring connector.

According to the antenna structure of the fourth aspect, the antenna side attachment section is inserted into the antenna attachment hole of the case, whereby the base of the antenna is electrically connected to the circuit board via the conductive member and the spring connector and the signal transmission path can be made comparatively short. Moreover, it is possible to switch the connection to an outside antenna from the antenna which is secured to the case by the insertion of the coaxial connector with a simple constitution. Therefore, transmission loss can be reduced.

According to the antenna structure of the fifth aspect, the antenna side attachment section is inserted into the antenna attachment hole of the case, whereby the ground conductor of the coaxial connector containing section becomes electrically connected to the circuit board via the spring connector. When the coaxial connector is inserted into the coaxial connector containing section, the central conductor and the outside conductor are each electrically connected to the circuit board.

According to the antenna structure of the sixth aspect, it is possible to switch the connection to an outside antenna from the antenna which is secured to the case by the insertion of the coaxial connector. The switching structure is simple and transmission loss can be reduced.

According to the antenna structure of the seventh aspect, not only the central conductor but also the outside conductor is electrically connected to the circuit board as appropriate when the coaxial connector is inserted.

While particular embodiments of the present invention have been shown and described, modifications may be made. It is therefore intended in the appended claims to cover all such changes and modifications of which fall within the true spirit and scope of the invention.

What is claimed is:

1. An antenna attachment structure comprising:

a case having a circuit board therein and comprising an antenna attachment hole for receiving an attachment section of an antenna;

a spring connector which is provided on said circuit board, said spring connector having a cylinder for containing a plunger, said plunger being moveable within said cylinder, and a spring force applied to one end of said plunger within said cylinder, another end of said plunger having a conductive tip that is forced in a direction which intersects an insertion path of said antenna attachment section; and a conductive member which is provided in said attachment section of said antenna and is electrically connected to a base of said antenna;

said conductive tip of said plunger elastically touching said conductive member when said attachment section is inserted into said antenna attachment hole while said conductive member is facing said plunger.

2. The antenna attachment structure of a case according to claim 1, wherein said conductive member has a directly contacting face, which the base of said antenna touches, and a sloping face which continues from the directly contacting face and is provided near a tip of said conductive member in the direction of insertion to the antenna attachment hole; and when said antenna attachment section is inserted into said antenna attachment hole, said conductive tip of said plunger elastically contacts said sloping face and said plunger is moved within said cylinder against said spring force by the wedge effect of said sloping face, thereby elastically touching said conductive member.

3. The antenna attachment structure of a case according to claim 1, wherein said case comprises a clip which said antenna attachment section clips to;

said antenna attachment section has a tongue-piece at an end inserted into said antenna attachment hole, a tip of the tongue-piece in the insertion direction being a free end and the tongue-piece elastically deforming toward the inside of said attachment section; and the tip of said tongue-piece comprising a clip section which clips to said clip when said attachment section has been inserted into said antenna attachment hole.

4. The antenna attachment structure of a case according to claim 1, said attachment section further comprising;

a through-hole which is provided in a section of said conductive member which said conductive tip of said plunger elastically contacts, the through-hole having a diameter which is narrower than said conductive tip;

a second spring connector which has a second plunger, one end of the second plunger passing through said through-hole and directly contacting said plunger and being elastically forced in the direction of its other end;

a coaxial connector containing section which is provided at the other end of said second plunger of said second spring connector for receiving a coaxial connector, a center conductor of said inserted coaxial connector forcibly moving said second plunger so as to separate said first plunger from said conductive member; and a coaxial connector insertion hole being provided in a section of said case which faces the coaxial connector containing section.

5. The antenna attachment structure according to claim 4, further comprising a ground conductor which is provided on the inner wall of said coaxial connector containing section and has a directly contacting face which an outside conductor of said inserted coaxial connector directly contacts and a sloping face which continues from the directly contacting face;

a third spring connector which has a third plunger and is provided on said circuit board;

said third plunger elastically contacting said ground conductor and becoming electrically connected thereto, and, when said antenna attachment section is inserted, said third plunger elastically contacting and being pressed by said sloping face, and then elastically contacting said ground conductor.

6. The antenna attachment structure of a case according to claim 1, wherein said spring force is applied by a spring coil housed within said cylinder.

7. An antenna attachment structure comprising:

a conductive member which is provided to one of an antenna attachment section and a case;

a spring connector which is provided on a circuit board in said case and has a plunger which elastically contacts said conductive member;

a through-hole which is provided in a section of said conductive member which said plunger elastically contacts, the through-hole having a diameter which is narrower than a tip face of said plunger;

a second spring connector which has a second plunger, one end of the second plunger passing through said through-hole and directly contacting said plunger and being elastically forced in the direction of its other end; and a coaxial connector containing section which is provided at the other end of said second plunger of said second spring connector for receiving a coaxial connector; wherein when said coaxial conductor has been inserted, a center conductor of said coaxial connector forcibly moves said second plunger so as to directly contact said plunger, thereby separating said plunger from said conductive member.

8. The antenna attachment section according to claim 6, wherein a ground conductor is provided on an inner wall of said coaxial connector containing section so as to directly contact an outside conductor of said inserted coaxial connector; and a plunger of a third spring connector provided on said circuit board elastically contacts said ground conductor and becomes electrically connected thereto.

9. The antenna attachment structure according to claim 6, wherein said case comprises a clip which said antenna attachment section clips to;

said antenna attachment section has a tongue-piece at an end inserted to an antenna attachment hole in said case, a tip of the tongue-piece in the insertion direction being a free end and the tongue-piece elastically deforming toward the inside of said attachment section; and the tip of said tongue-piece comprising a clip section which clips to said clip when said attachment section has been inserted into said antenna attachment hole.

10. The antenna attachment structure according to claim 6, wherein a first thread is provided around an insertion side of a holder of said antenna attachment structure and a second thread is provided in an antenna attachment hole on a top face of said case, such that said holder screws into said antenna attachment hole until fully seated.

11. An antenna attachment structure of a case comprising:

a case having a circuit board therein and comprising an antenna attachment hole for receiving an attachment section of a first antenna;

a spring connector which is provided on said circuit board and has a first plunger, elasticity being applied to the plunger so that said first plunger protrudes in a direction which is substantially parallel to a direction in which a connector for connecting a second antenna is inserted into said case and wherein said first plunger intersects the insertion direction of said attachment section into said case; and a conductive member which is provided in said attachment section of said first antenna and is electrically connected to a base of said first antenna;

said plunger elastically touching said conductive member when said attachment section is inserted into said antenna attachment hole while said conductive member is facing said plunger.

12. The antenna attachment structure of a case according to claim 11, wherein said conductive member has a directly contacting face, which the base of said first antenna touches, and a sloping face which continues from the directly contacting face and is provided near a tip of said conductive member in the direction of insertion to the antenna attachment hole; and when said antenna attachment section is inserted into said antenna attachment hole, said first plunger elastically contacts said sloping face and is pushed by a wedge effects of said sloping face, thereby elastically touching said conductive member.

13. The antenna attachment structure according to claim 11, wherein said case comprises a clip which said antenna attachment section clips to;

said antenna attachment section has a tongue-piece at an end inserted into said antenna attachment hole, a tip of the tongue-piece in the insertion direction being a free end and the tongue-piece elastically deforming toward the inside of said attachment section; and the tip of said tongue-piece comprising a clip section which clips to said clip when said attachment section has been inserted into said antenna attachment hole.

14. The antenna attachment structure according to claim 11, said attachment section further comprising:

a through-hole which is provided in a section of said conductive member which said first plunger elastically contacts, the through-hole having a diameter which is narrower than a tip face of said first plunger;

a second spring connector which has a second plunger, a first end of the second plunger being configured to pass through said through-hole and directly contact said first plunger, said second plunger being elastically forced in a direction away from said first plunger; and a coaxial connector containing section which is provided at the other end of said second plunger of said second spring connector for receiving a coaxial connector for connecting said second antenna;

a center conductor of said coaxial connector forcibly moving said second plunger so as to contact said first plunger and separate said first plunger from said conductive member, and a coaxial connector insertion hole being provided in a section of said case which faces the coaxial connector containing section.

15. The antenna attachment structure according to claim 14, further comprising:

a ground conductor which is provided on the inner wall of said coaxial connector containing section and has a directly contacting face which an outside conductor of said coaxial connector directly contacts and a sloping face which continues from the directly contacting face; and a third spring connector which has a third plunger and is provided on said circuit board;

said third plunger elastically contacting said ground conductor and electrically connecting said ground conductor to said circuit board when said coaxial conductor is inserted in said coaxial connector containing section.

16. An antenna attachment structure comprising:

a conductive member which is provided to one of an antenna attachment section of a first antenna and a case;

a first spring connector which is provided on a circuit board in said case and has a first plunger which elastically contacts said conductive member;

a through-hole which is provided in a section of said conductive member which said first plunger elastically contacts, the through-hole having a diameter which is narrower than a tip face of said first plunger;

a second spring connector which has a second plunger, a first end of the second plunger being configured to pass through said through-hole and directly contact said first plunger, said second plunger being elastically forced in a direction away from said first plunger; and a coaxial connector containing section which is provided at the other end of said second plunger of said second spring connector for receiving a coaxial connector for connecting a second antenna; wherein when said coaxial connector has been inserted, a center conductor of said coaxial connector forcibly moves said second plunger so as to directly contact said first plunger, thereby separating said first plunger from said conductive member.

17. The antenna attachment section according to claim 16, wherein a ground conductor is provided on an inner wall of said coaxial connector containing section so as to directly contact an outside conductor of said coaxial connector when said coaxial connector is inserted into said coaxial connector containing section; and a third plunger of a third spring connector provided on said circuit board elastically contacts said ground conductor and becomes electrically connected thereto.

18. A method for coupling an antenna attachment structure to a case, the method comprising:

inserting said antenna attachment structure having a first antenna into a receiving hole of said case;

applying a spring force to a first plunger of a first spring connector coupled to said case, wherein said first plunger has a range of movement substantially perpendicular to a direction of insertion of said antenna attachment structure and substantially parallel to a direction in which a connector for connecting a second antenna is inserted into said case and such that said spring force forces at least a portion of said first plunger into a pathway of said antenna attachment structure;

slidingly coupling a sloping face of a conductive member of said antenna attachment structure to said first plunger until said antenna attachment structure is fully seated in said case.

19. The method of claim 18, wherein said act of slidingly coupling comprises slidingly coupling said sloping face of said conductive member to said first plunger until said antenna attachment structure is fully clipped into place.

20. A method for coupling an antenna attachment structure to a case, the method comprising:

screwing said antenna attachment structure into a receiving hole of said case in a direction substantially perpendicular to a direction of insertion into said case of a connector for connecting a second antenna to said case, until said antenna attachment structure is fully seated, wherein said antenna attachment structure contains a first antenna, and wherein as said antenna attachment structure is screwed into said receiving hole, a conductive clip of said antenna attachment structure becomes slidingly coupled to a flexible conductive member of said case, thereby forming a conductive link between said first antenna and a circuit board of said case.

* * * * *